US008905871B2

(12) United States Patent
Wagner et al.

(10) Patent No.: US 8,905,871 B2
(45) Date of Patent: Dec. 9, 2014

(54) APPARATUS AND METHOD FOR BUNT TRAINING

(71) Applicant: Bullpen Products, LLC, Urbandale, IA (US)

(72) Inventors: Matthew William Wagner, Urbandale, IA (US); Aron Wesley Fleischmann, Huxley, IA (US)

(73) Assignee: Bullpen Products, LLC, Urbandale, IA (US)

( * ) Notice: Subject to any disclaimer, the term of this patent is extended or adjusted under 35 U.S.C. 154(b) by 61 days.

(21) Appl. No.: 13/680,556

(22) Filed: Nov. 19, 2012

(65) Prior Publication Data

US 2013/0130844 A1 May 23, 2013

Related U.S. Application Data

(60) Provisional application No. 61/629,460, filed on Nov. 21, 2011.

(51) Int. Cl.

| | |
|---|---|
| ***A63B 69/00*** | (2006.01) |
| ***A63B 71/14*** | (2006.01) |
| *A63B 59/06* | (2006.01) |
| *A63B 59/00* | (2006.01) |

(52) U.S. Cl.

CPC ..... *A63B 69/0002* (2013.01); *A63B 71/14* (2013.01); *A63B 59/06* (2013.01); *A63B 59/0014* (2013.01); *A63B 2069/0008* (2013.01); *A63B 2209/10* (2013.01); *A63B 2210/50* (2013.01)

USPC ..... 473/457; 473/422; 473/458

(58) Field of Classification Search

CPC ..... A63B 69/0002; A63B 69/38; A63B 69/0015; A63B 59/06; A63B 59/0014; A63B 2069/0008; A63B 2069/0006; A63B 2069/0002; A63B 2243/0004; A63B 2243/0008; A63B 2243/0012; A63B 2243/0016

USPC ..... 473/422, 431, 457, 451, 516, 538, 549, 473/552, 568, 564

See application file for complete search history.

(56) References Cited

U.S. PATENT DOCUMENTS

| | | | | | |
|---|---|---|---|---|---|
| 4,214,751 | A | * | 7/1980 | Simpson | 473/457 |
| D334,085 | S | * | 3/1993 | Niemann | D29/113 |
| 5,246,228 | A | * | 9/1993 | Hope, II | 473/465 |
| 5,605,325 | A | | 2/1997 | Haringa | |
| 5,632,090 | A | | 5/1997 | Smith | |

(Continued)

OTHER PUBLICATIONS

Buntdown Baseball Training Bat (U.S. D543,251S), Holyoke, Massachusetts, 2012, retrieved from the Internet: www.buntdownbat.com/about-us.htm on Oct. 30, 2012 (1 page).

*Primary Examiner* — Mitra Aryanpour
(74) *Attorney, Agent, or Firm* — McKee, Voorhees, & Sease

(57) ABSTRACT

A bunt training device includes a shield with opposite ends which is mounted to a baseball or softball bat using one or more straps. The device is mounted on the bat in a position which allows a batter to slide his or her top hand to the end of the device adjacent the barrel of the bat for bunting practice. The shield protects the batter's top hand from a pitched ball and thereby eliminates or reduces the fear a batter may have when bunting. The device may be formed as a separate shield to be mounted on a conventional bat, or the shield and bat can be formed as a single unit for bunting practice.

6 Claims, 17 Drawing Sheets

(56) References Cited

U.S. PATENT DOCUMENTS

| | | | | |
|---|---|---|---|---|
| 5,695,419 | A | 12/1997 | Haringa | |
| 6,093,114 | A | 7/2000 | Haringa | |
| 6,186,909 | B1 * | 2/2001 | Swanson, Jr. | 473/422 |
| 6,254,498 | B1 * | 7/2001 | Tyner | 473/437 |
| 6,533,685 | B1 | 3/2003 | Otten et al. | |
| D543,251 | S * | 5/2007 | Kelliher | D21/725 |
| 7,331,885 | B2 * | 2/2008 | Thomas | 473/564 |
| 7,985,147 | B1 * | 7/2011 | Allen | 473/457 |
| 8,066,590 | B2 * | 11/2011 | Doherty | 473/457 |
| 8,092,322 | B1 * | 1/2012 | Smallcomb et al. | 473/451 |
| 8,277,341 | B1 * | 10/2012 | Vignola | 473/457 |
| 2003/0134698 | A1 * | 7/2003 | Clark et al. | 473/457 |
| 2008/0039241 | A1 * | 2/2008 | Pope | 473/457 |
| 2010/0087279 | A1 * | 4/2010 | Jennings et al. | 473/516 |
| 2011/0250994 | A1 * | 10/2011 | Budzielek | 473/457 |
| 2013/0130844 | A1 * | 5/2013 | Wagner et al. | 473/457 |

* cited by examiner

APPARATUS AND METHOD FOR BUNT TRAINING

CROSS-REFERENCE TO RELATED APPLICATIONS

This application claims priority under 35 U.S.C. §119 of a provisional application Ser. No. 61/629,460 filed Nov. 21, 2011, and which application is hereby incorporated by reference in its entirety.

FIELD OF THE INVENTION

This invention relates to a method and apparatus for teaching the art of bunting a baseball or softball. The following description uses baseball and softball interchangeably or synonymously with regard to this invention.

BACKGROUND OF THE INVENTION

It is common practice within the games of baseball and softball to bunt, or more specifically, square the body toward the pitcher and use the baseball bat to dampen the rebound trajectory of the batted ball in a forward motion toward the pitcher. The art of bunting requires that while batting, the top hand be slid to a position near the barrel of the bat for the purpose of control. If the top hand is incorrectly positioned, the art and control of bunting is sacrificed.

To bunt a ball means having direct contact between a pitched ball and the ball bat in such a manner as to dampen, or absorb, the kinetic energy of the pitched ball by the action of the bat so as to have minimal rebound of the ball into the field of play. This is a physical event which requires proper hand-eye coordination, precise skill and controlled touch of the bat to the pitched ball. Additionally, the art of bunting requires being able to control the direction of the bunted ball either toward the pitcher, or toward either the first or third base foul lines. In summary, the art of bunting is about controlling the rebound location of a pitched ball with the ball bat.

While bunting a ball, the top hand is slid from the handle location (or grip) to the barrel portion of the bat. The hand is positioned such that the thumb and forefinger are formed to positively receive the convex curvature of the bat. This positioning of the hand tends to promote the feeling of leaving the remaining fingers on the top hand vulnerable to exposure of the pitched ball, and thus the possibility of being hit by the pitched ball. For younger players, and others first learning the art of bunting, this aspect can be intimidating and instill fear in the batter from their hand being hit by the pitched ball. This fear can cause the batter to position their top hand closer to the handle of the bat than the barrel, causing improper position and lack of bat control. In addition to being concerned about being hit by the pitched ball, the act of training the body for specialized events such as bunting a ball requires constant training and muscle memory exercises such that in a real-time, fast-paced game situation, the natural actions of the mind and body are instinctive. To instill this level of natural mind and body instinct, discipline of the top hand position must be mastered.

There is not a commercially available solution for these problems for bunt training. Common practice of training batters in the art of bunting, especially youth in Little League®, is to demonstrate the bunting technique during instructional drills such as soft-toss and live batting practice. While these are techniques and practice methods which positively benefit the learner, a method and apparatus to support proper learning is needed.

The present invention satisfies the following objectives:

- provides a means of quickly and easily attaching a training apparatus to a baseball or softball bat;
- provides means of an apparatus to protect the top hand and fingers from being hit with a pitched baseball or softball while practicing the art of bunting;
- provides means of an apparatus to properly locate the top hand at a position to provide the optimum portion of the barrel of the bat to be used for bunting;
- provides a method of protecting the top hand and fingers from being hit by a pitched ball while bunting;
- provides a method of properly locating the top hand position while practicing the art of bunting; and
- provides an apparatus and method of directly promoting brand awareness for a company within the baseball/softball market space by utilizing the invention for space to locate an industry-related company logo.

SUMMARY OF THE INVENTION

An apparatus for bunt training includes a shield which is mounted to the bat with at least one strap. The shield extends along a front portion of the bat at a location adjacent the barrel or sweet spot of the bat so as to reside in front of the batter's top hand when the batter is in the bunting position. The shield has two functions: (1) protecting the batter's top hand from a pitched ball; and (2) positioning the batter's top hand at the appropriate location along the bat so as to best control the bat during bunting.

A second embodiment of the invention comprises a one-piece bat and shield combination wherein the shield is integrally formed with the bat. In one version of this integrally formed bat and shield, the shield includes legs at opposite ends so as to define a gap between the shield body and the bat. In a second version of the integral bat and shield bunt training device, the legs are eliminated such that the shield body is adjacent the bat, with no gap or space therebetween.

DETAILED DESCRIPTION OF THE INVENTION

Figure 1:
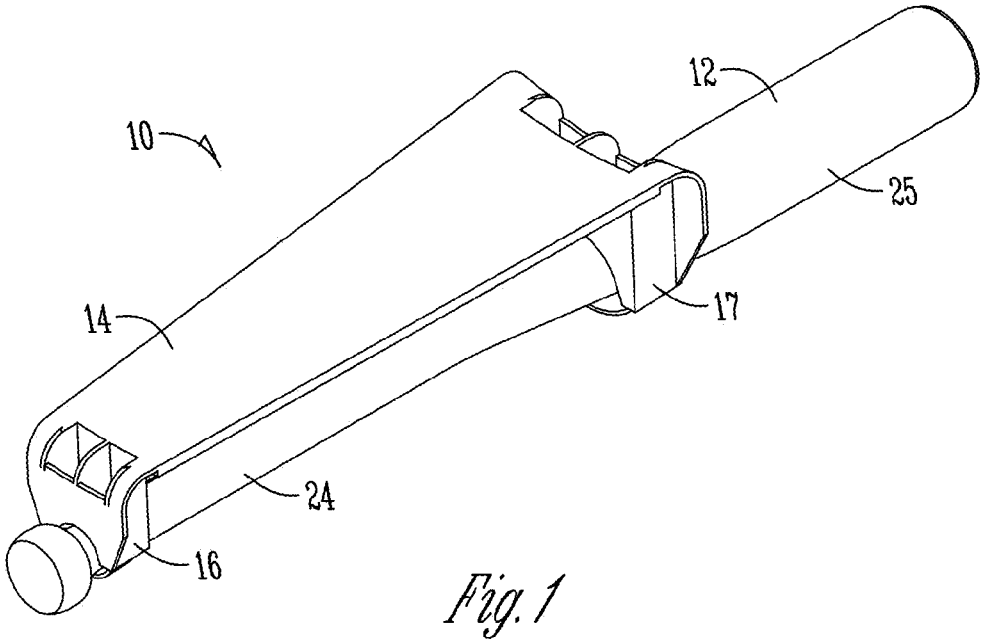
FIG. 1 is a front perspective view of the bunt training tool or device of the present invention mounted on a bat.
Figure 2:
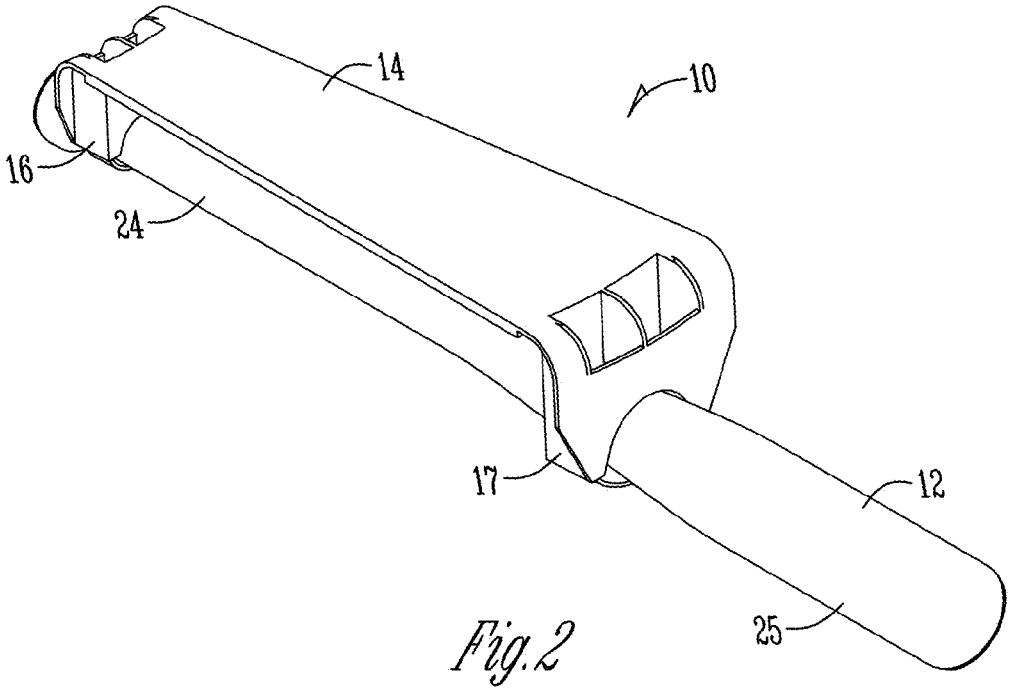
FIG. 2 is another front perspective view of the bunt training tool mounted on a bat.
Figure 3:
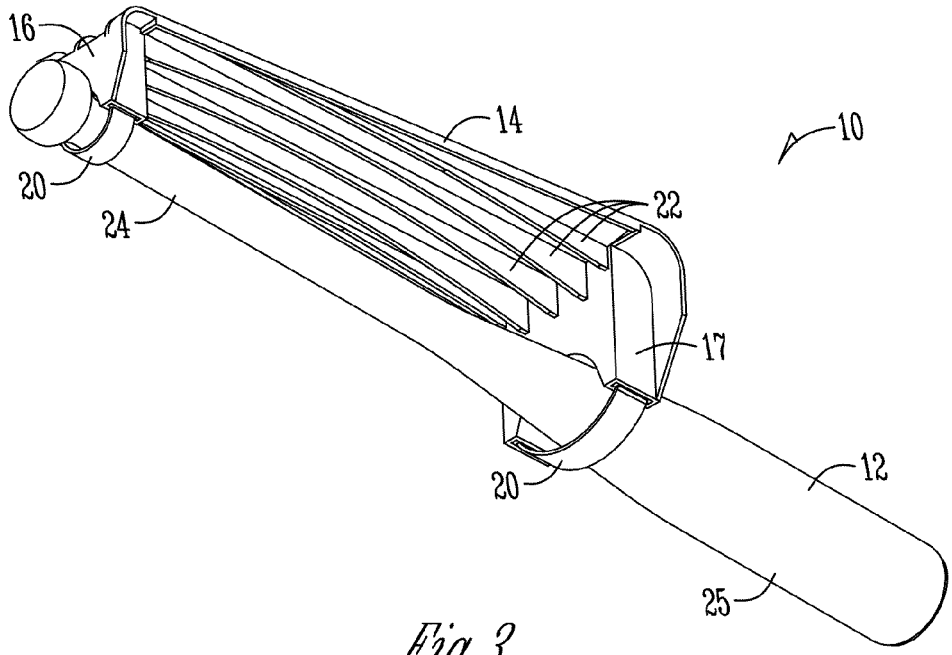
FIG. 3 is a rear perspective view of the bunt training tool mounted on a bat.
Figure 4:
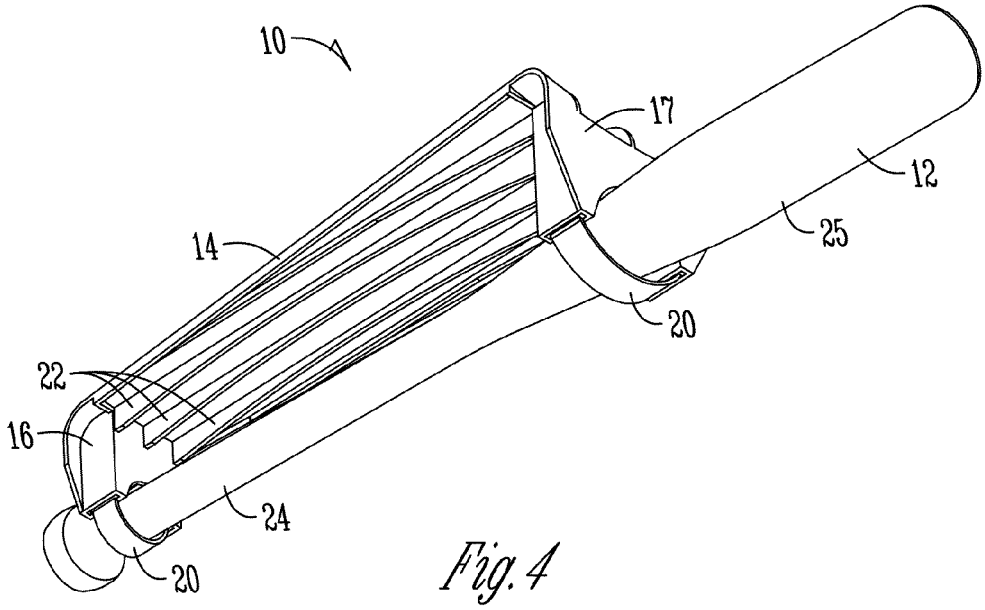
FIG. 4 is another rear perspective view of the bunting tool mounted on a bat.
Figure 5:
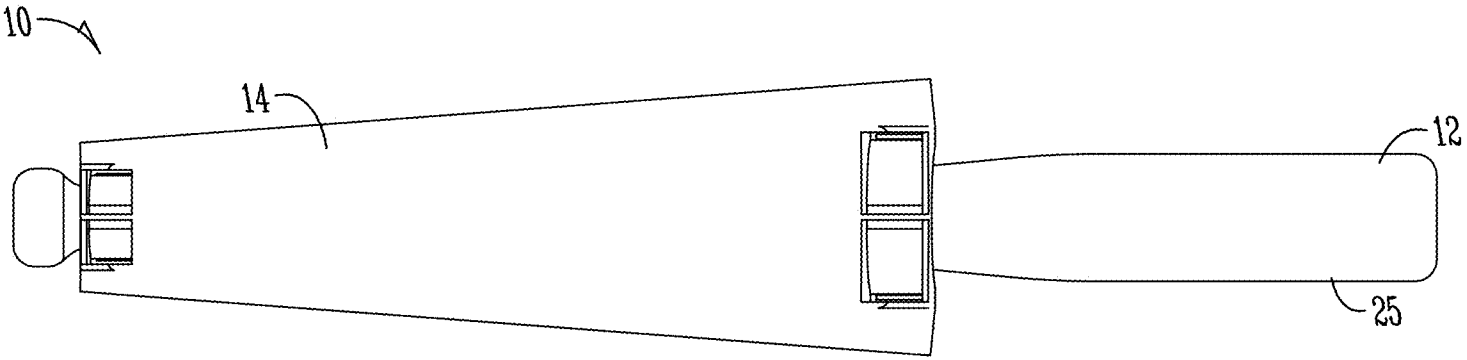
FIG. 5 is a front elevation view of the bunt training tool mounted on a bat.

The bunt training apparatus, device or tool of the present invention is generally designated by the reference numeral 10 in the drawings. This apparatus or device 10 is adapted to be mounted on a baseball or softball bat 12, as shown in FIGS. 1-9.

Figure 7:
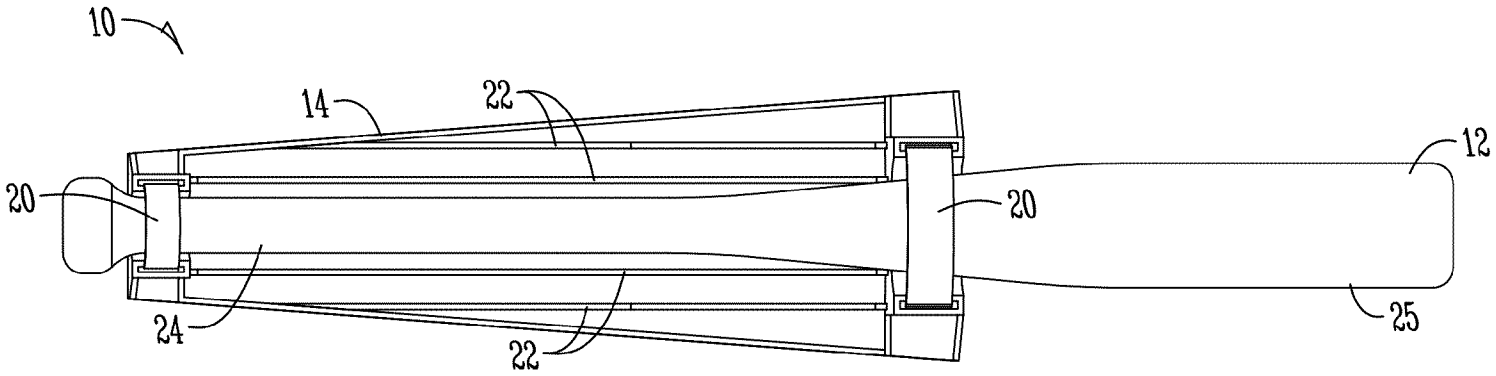
FIG. 7 is a bottom plan view of the bunting tool mounted on a bat.
Figure 8:
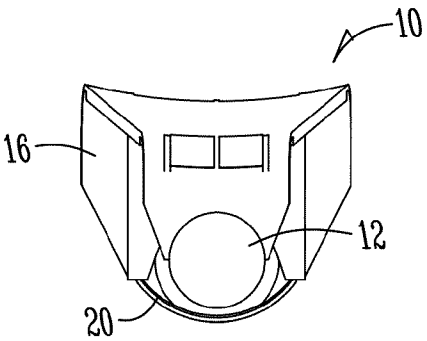
FIG. 8 is an end view from the handle end of the bat showing the bunting tool mounted on the bat.
Figure 9:
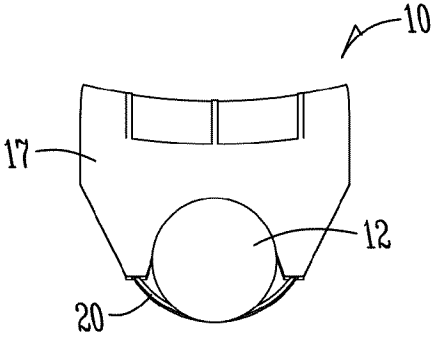
FIG. 9 is an end view from the barrel end of the bat showing the bunting tool mounted on the bat.
Figure 10:
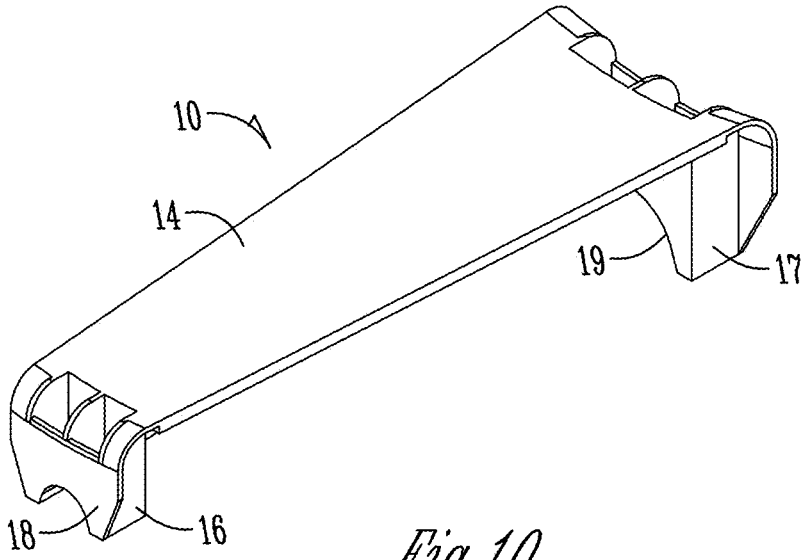
FIGS. 10-11 are front perspective views of the bunting tool.
Figure 11:
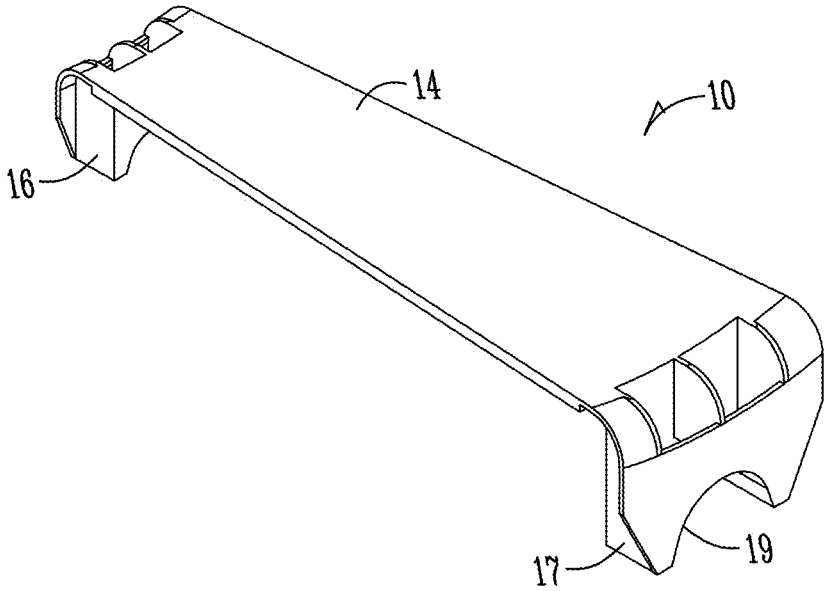

The device 10 is preferably made of plastic with high impact resistance, such as that used for batting helmets. FIGS. 1-18 show one embodiment of the apparatus 10 having a front shield or plate 14 with a pair of legs 16, 17 at the opposite ends of the shield 14. The legs 16, 17 terminate in curved ends 18, 19, respectively, for engagement with the bat 12. The device 10 is attached to the bat 12 by one or more fasteners, such as a pair of straps 20 which extend through the legs 16, 17 and around the bat 12, as best seen in FIGS. 7-9. Preferably, the straps 20 are hook and loop (Velcro®) straps having opposite ends which overlap one another so as to accommodate any bat diameter. Alternatively, the straps 20 may be elastic to accommodate different sized bats, or may include other fasteners, such as snaps, clamps, latches or buckles to mount the device 10 on the bat 12.

Figure 6:
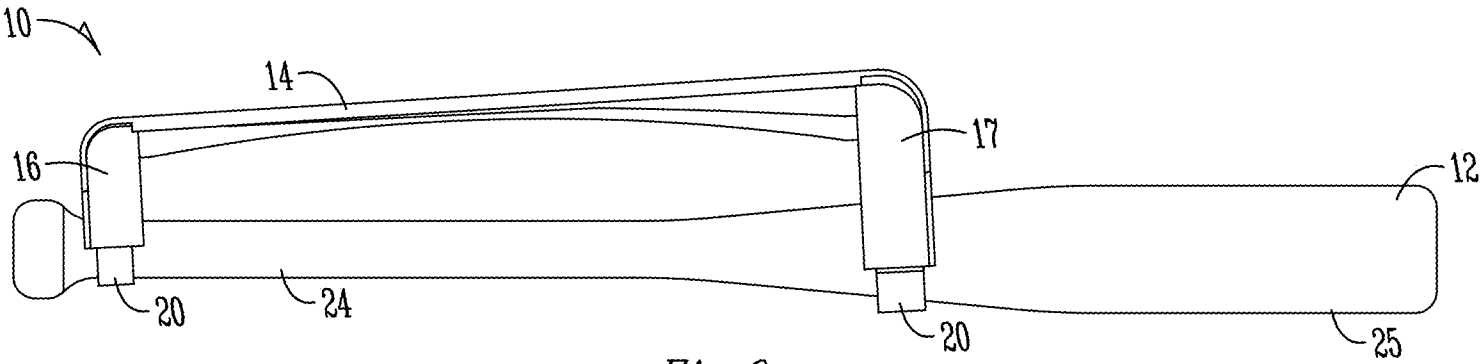
FIG. 6 is a side elevation view of the bunting tool mounted on a bat.
Figure 12:
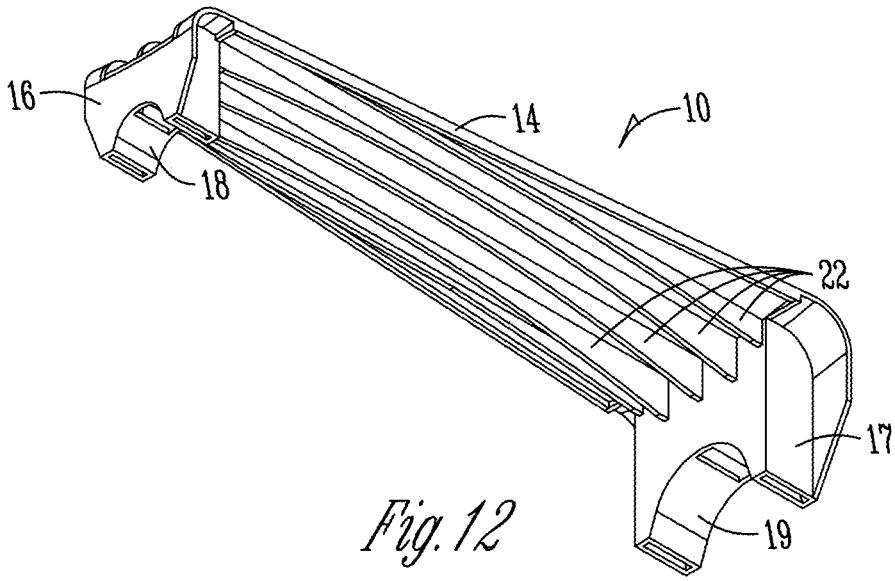
FIGS. 12-13 are rear perspective views of the bunting tool.
Figure 13:
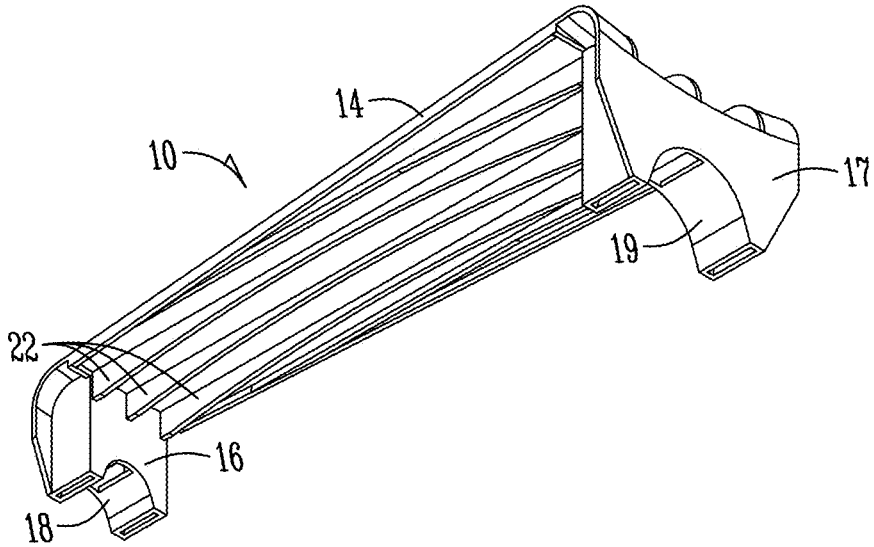
Figure 14:
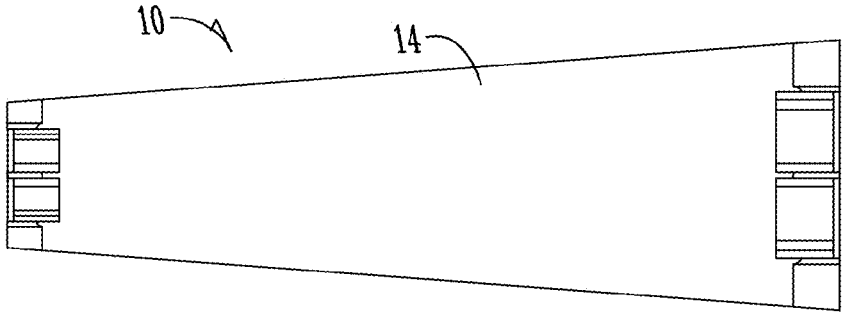
FIG. 14 is a front elevation view of the bunting tool.
Figure 15:
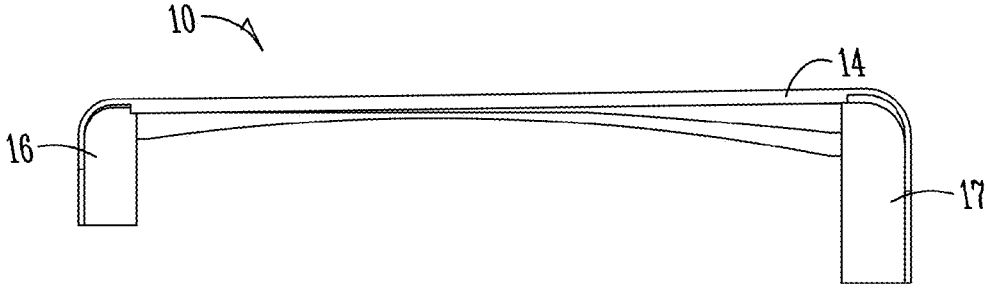
FIG. 15 is a side elevation view of the bunting tool.
Figure 16:
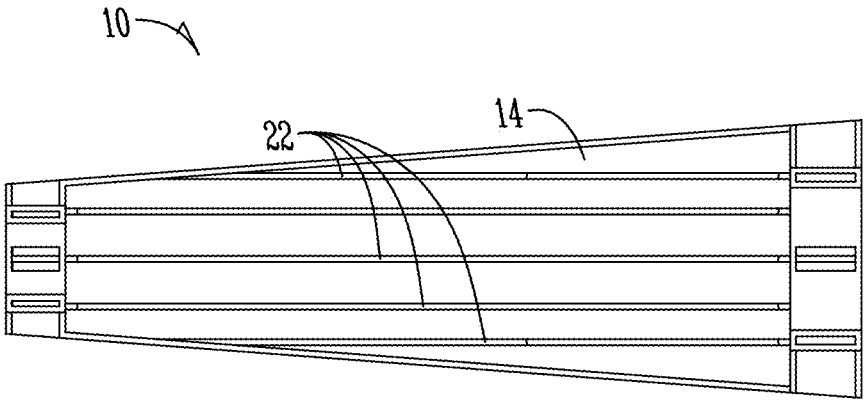
FIG. 16 is a rear perspective view of the bunting tool.
Figure 17:
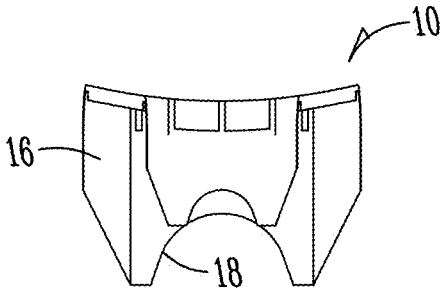
FIGS. 17-18 are elevation views of the bunting tool from opposite ends.
Figure 18:
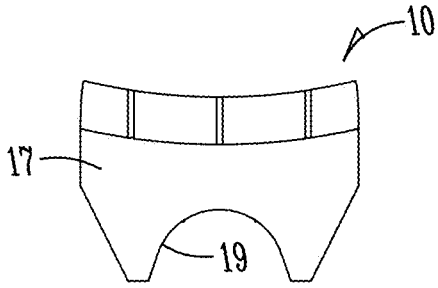

As seen in FIG. 6, the legs 16, 17 are preferably the same length and sufficiently long so as to space the shield 14 from the bat 12. The curved end 18 has a smaller radius than the curvature of the end 19 so as to better fit the smaller diameter of the bat handle 24 compared to the bat barrel 25. As best seen in FIGS. 12 and 13, the rear surface of the shield 14 includes reinforcing ribs 22 so as to strengthen the shield 14. If desired, padding may be provided on the rear surface of the shield 14.

FIGS. 8, 9, 17 and 18 show that in a preferred embodiment, the front of the shield 14 has a concave, curved or non-planar surface. Alternatively, the front surface can be flat or planar, or convex.

When the device 10 is mounted on the bat 12, the device provides two functions. First, the shield 14 protects the batter's top hand from being hit by a pitched ball, and thereby reduces or eliminates the fear which some batters may have of being hurt by the pitched ball. Second, the device 10 correctly positions the batter's upper hand at the proper location of the ball 12 during bunting. When a batter is preparing to bunt, he or she can easily slide their top hand along the bat to the leg 17. With sufficient training using the device 10, a batter will learn to quickly position their top hand at the appropriate place on the bat, even after the apparatus 10 has been removed from the bat 12.

Figure 19:
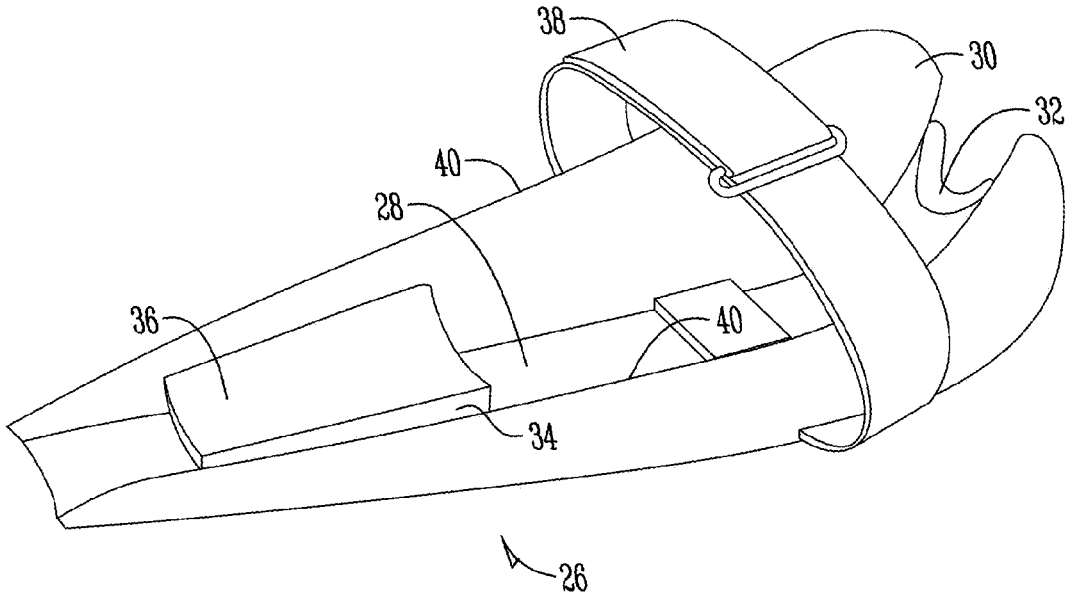
FIG. 19 is a perspective view of an alternative embodiment of the bunt training device of the present invention.
Figure 20:
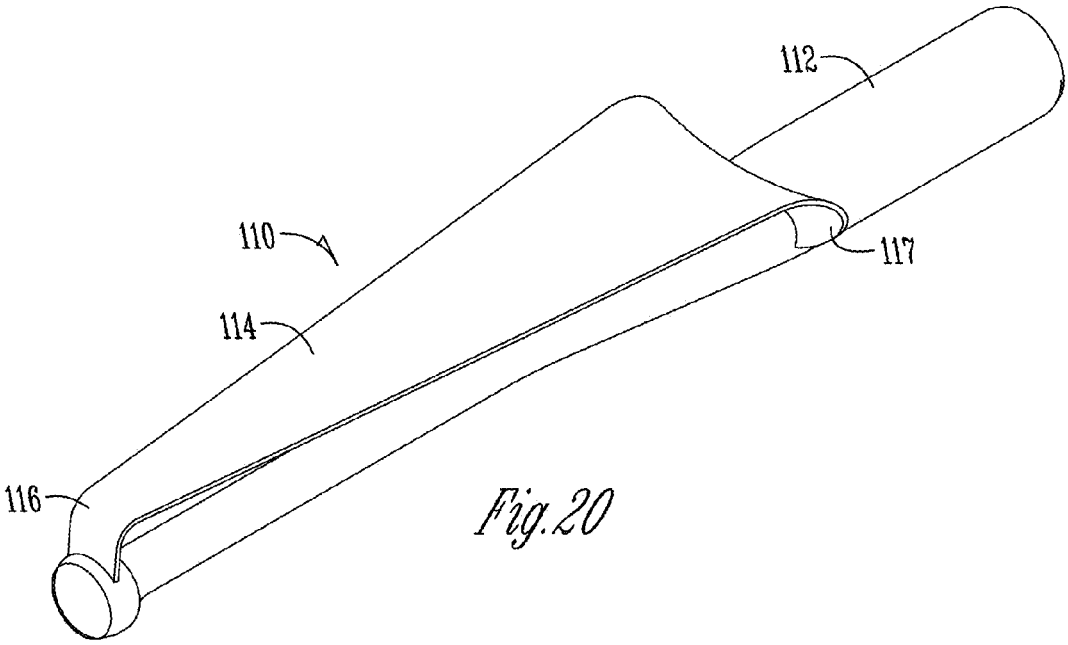
FIGS. 20-28 show views similar to FIGS. 1-9 for a second embodiment of the bunt training device wherein the bat and shield are formed as a single, one-piece combination.
Figure 21:
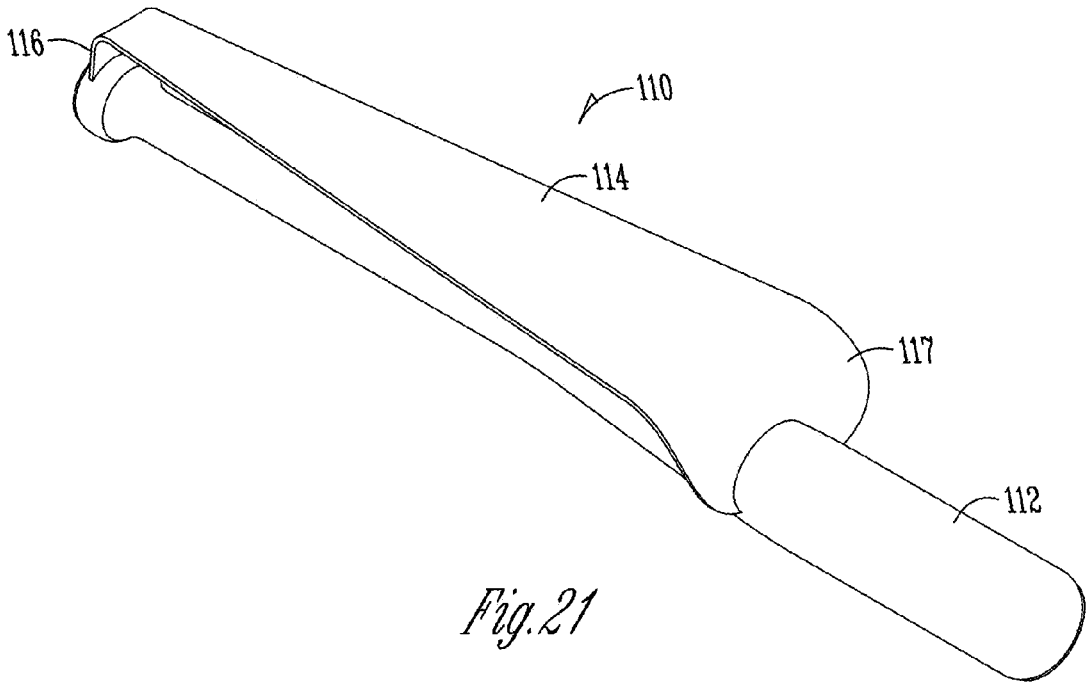
Figure 22:
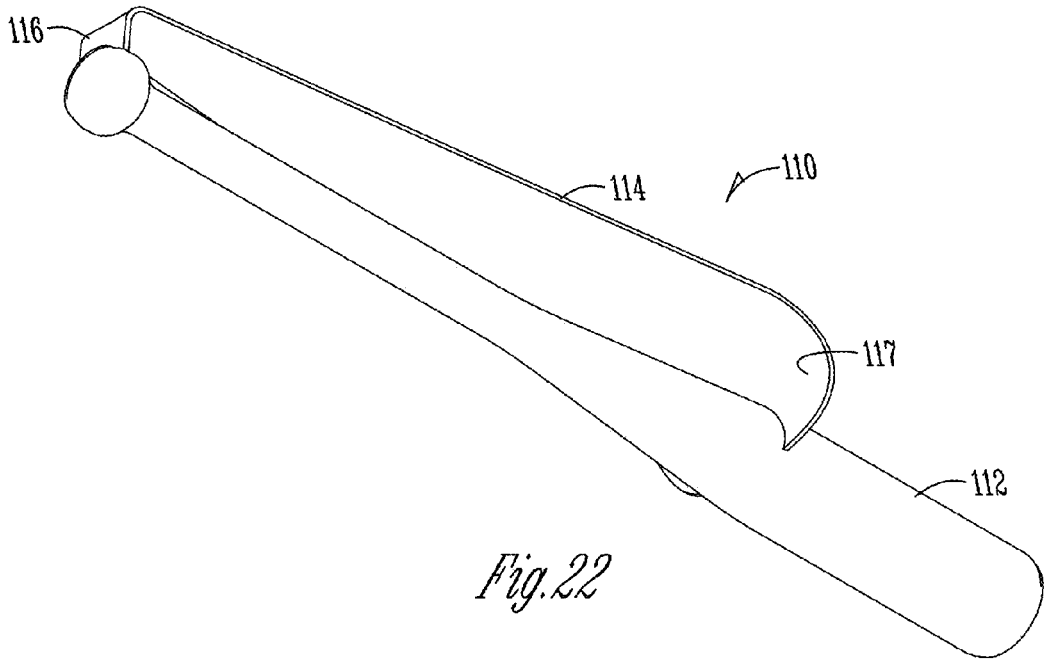
Figure 23:
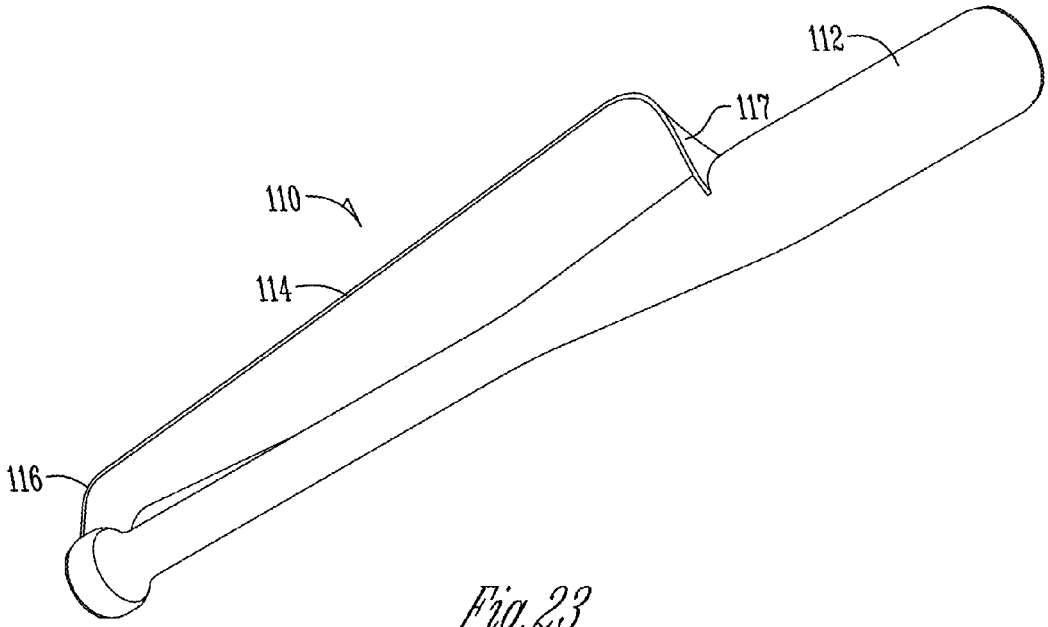
Figure 24:
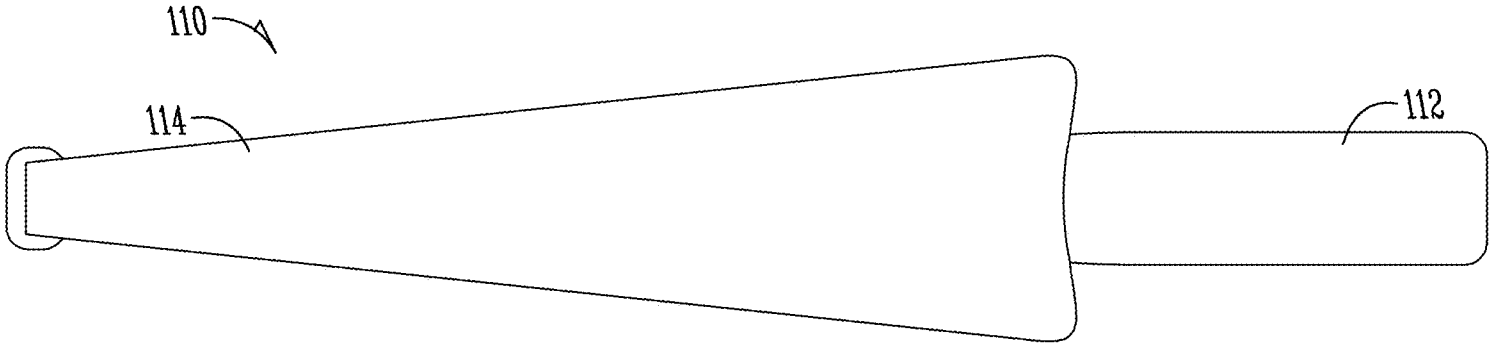

FIG. 19 shows another embodiment of a bunt training device 26 according to the present invention. The device 26 includes front shield 28 with forward end in the form of a leg 30. The leg 30 has a curved recess 32 for engagement with the bat adjacent the barrel. The rear surface of the shield 30 may include a pad 34 having a curved surface 36 for engaging the bat 12. The device 26 is mounted to the bat 12 using one or more straps 38, similar to the straps 20 of the device 10. The upper and lower edges 40 of the shield 28 curve rearwardly for additional hand protection. The width of the shield 28 increases from the handle end to the barrel end.

When used in practice, the device 10 exists such that the top hand can readily and easily be slid from the typical stacked, hand-on-hand batting position. From this position, the top hand is linearly traversed from the handle end of the bat toward the barrel end 25 of the bat 12, all-the-while being protected from being hit from the pitched ball. In this way, the device 10 limits movement of the top hand to the proper location on the barrel 25 of the bat 12 for proper bunting technique. The device 10 is designed so as to leave available an adequate length of the barrel 25 of the bat 12 for use to contact the ball. This portion of the barrel 25 of the bat 12 is commonly referred to as the "sweet spot" of the bat. This is the particular location of the bat which provides optimum control when contacting the pitched ball. By using the device 10 with habitual practice and discipline, the mind and body become trained to instinctively use the "sweet spot" of the bat for perfecting the art of bunting a pitched ball.

Yet another advantage of the device 10 is from the marketing perspective. The shield 14, 28 of the device provides an adequate advertising space from brand awareness and marketing advantages. For example, for the companies who market and promote products into the baseball/softball markets, this device 10 provides an overt and distinct marketing opportunity.

Figure 25:
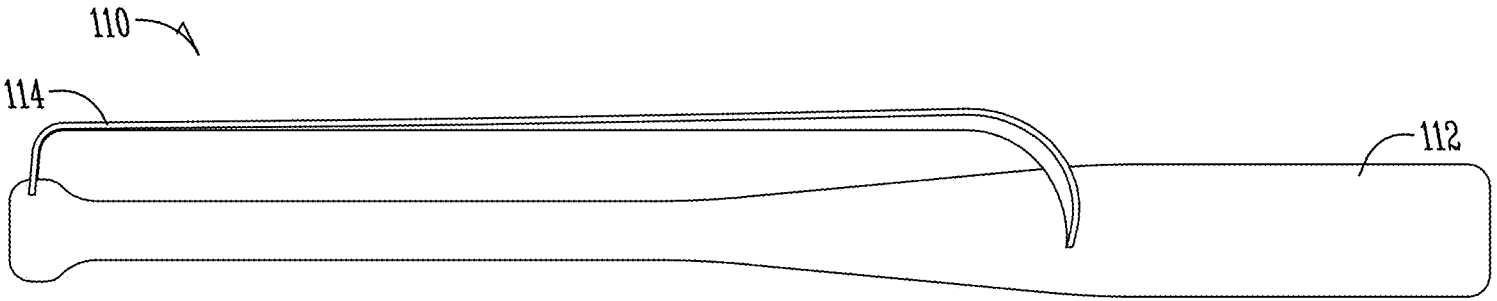
Figure 26:
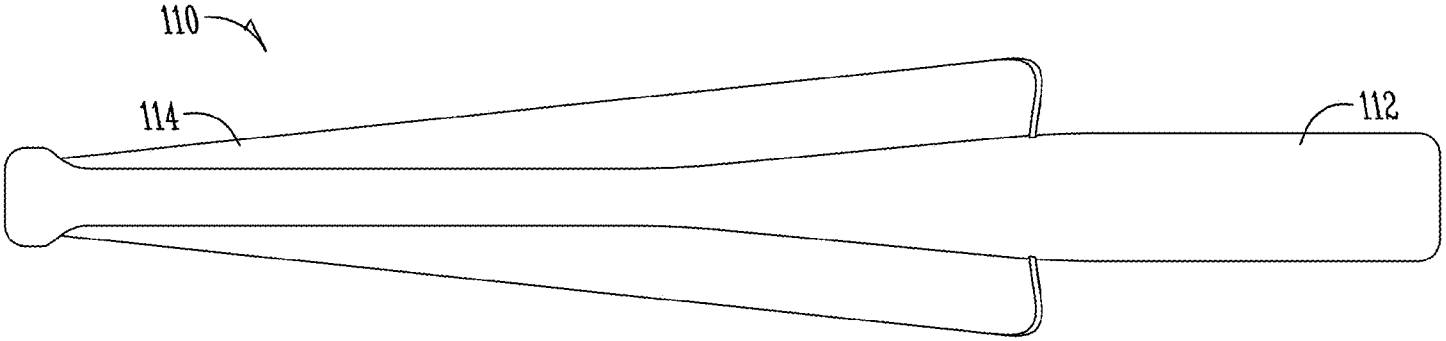
Figure 27:
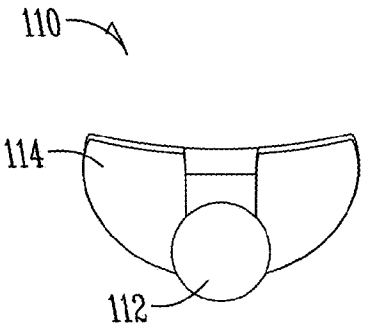
Figure 28:
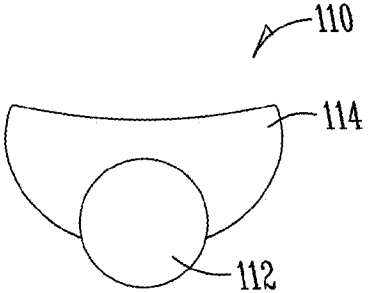
Figure 29:
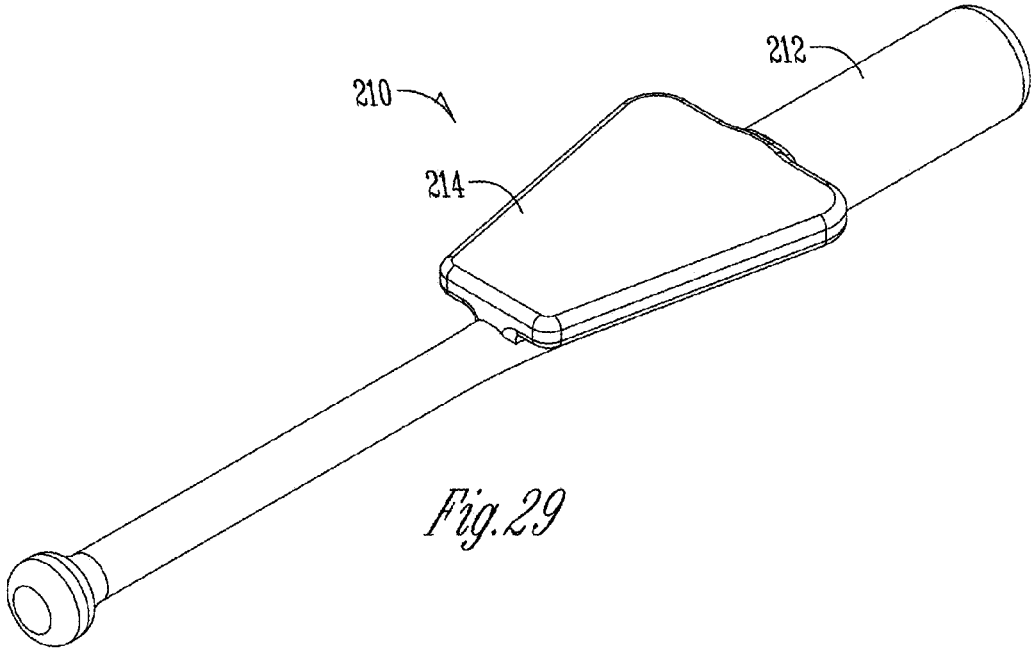
FIGS. 29-37 show a third embodiment for a bunt training device wherein the bat and shield are formed as a one-piece integral unit.
Figure 30:
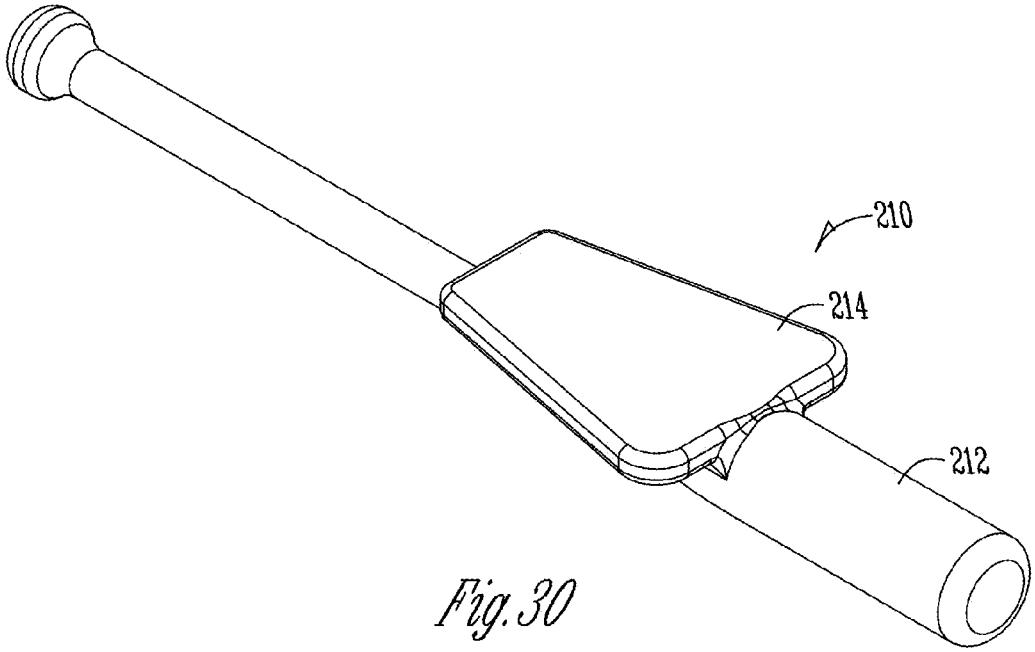
Figure 31:
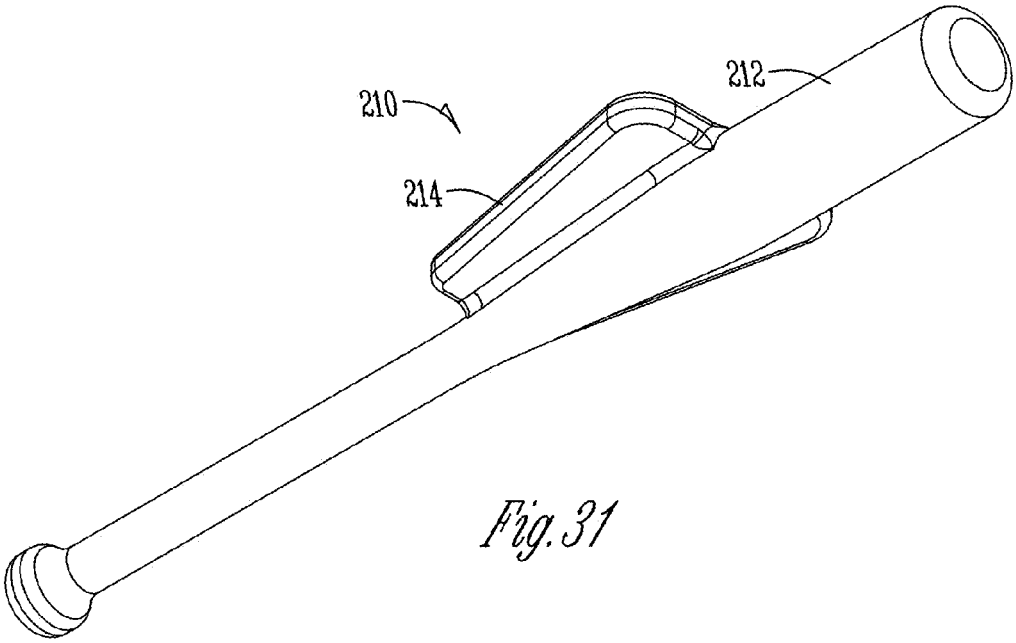
Figure 32:
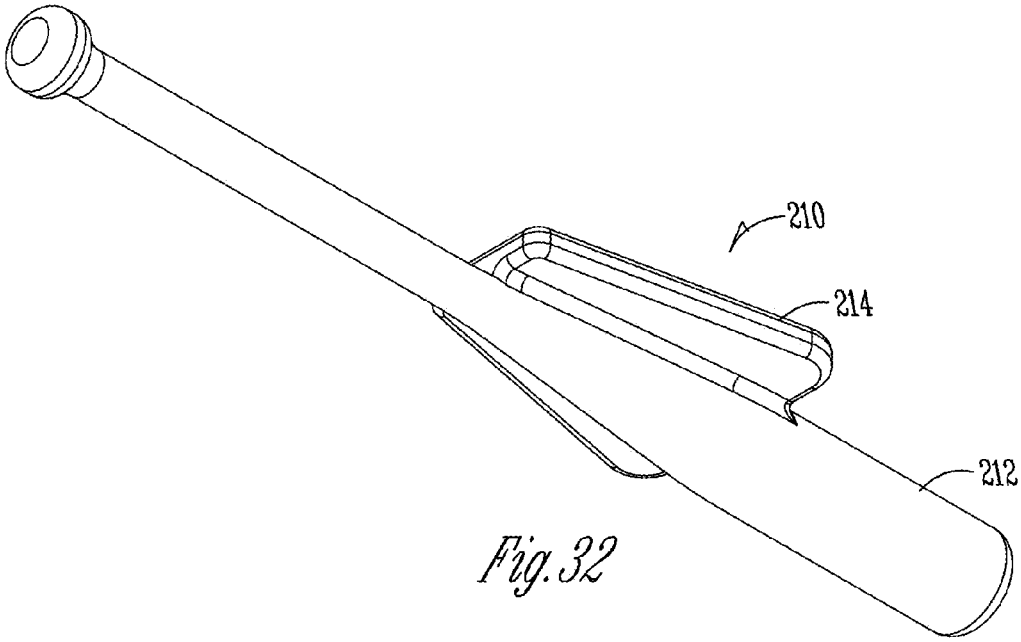
Figure 33:
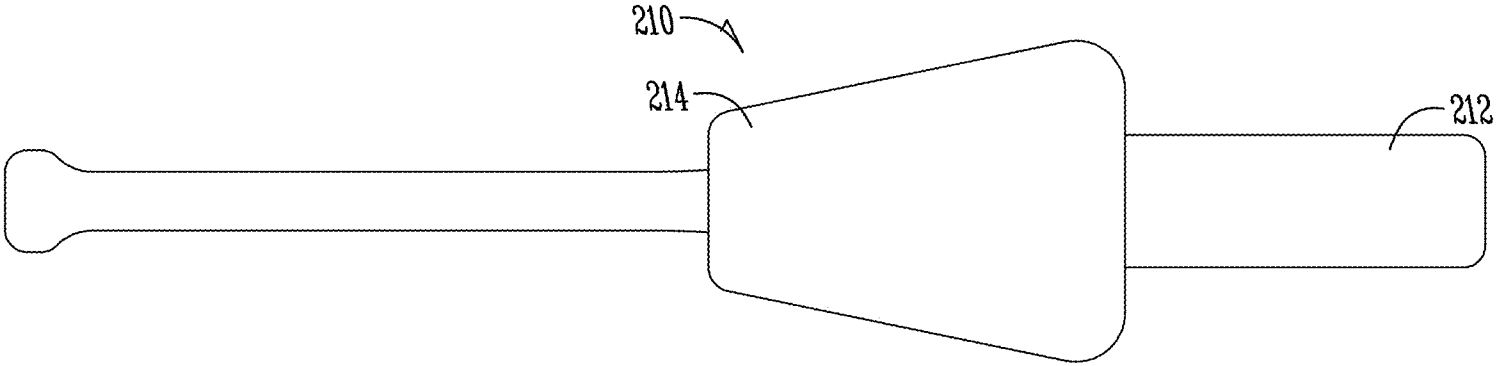
Figure 34:
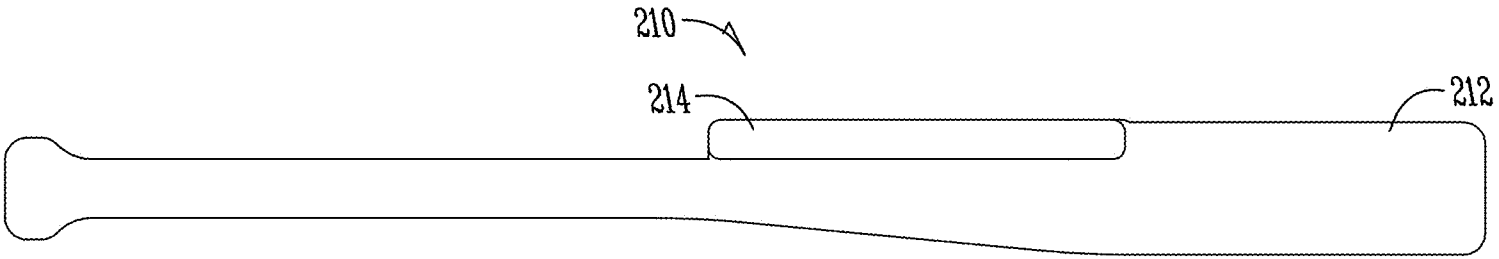
Figure 35:
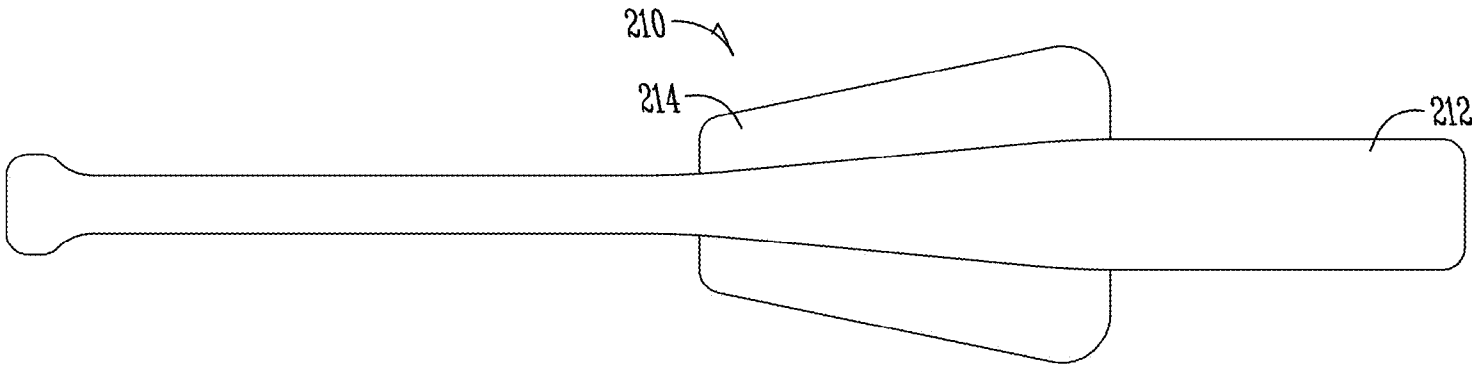

As an alternative to the two-piece embodiments of the invention shown in FIGS. 1-19, the shield and bat can be formed as a one-piece apparatus, FIGS. 20-28 show a bunt training device 110 wherein the bat 112 and shield 114 are formed as a single unit, such that the shield cannot be removed from the bat. The shield 110 includes legs 116, 117 which are integrally connected to the bat 112 so as to provide a space or gap between the shield 114 and the bat 112, as best seen in FIG. 25. As best seen in FIGS. 27 and 28, the front surface of the shield 114 is concave, though it is understood that this surface may be flat or convex. The single piece device 110 can be made in multiple sizes, such as a shorter length for youth, a medium length for teenagers, and a longer length for adults.

Figure 36:
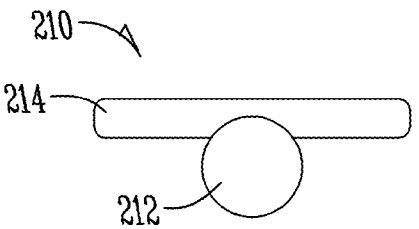
Figure 37:
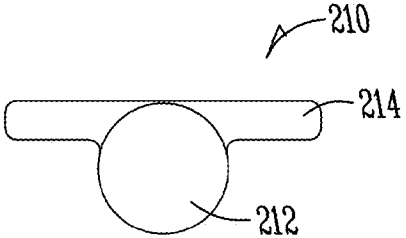

Another alternative of the bunt training device 210 is shown in FIGS. 29-37. The device 210 has a one-piece construction, with the bat 212 and shield 214 formed integrally with one another. In this embodiment, the shield 214 does not include legs, such that there is no gap between the shield 214 and the bat 212. As seen in FIGS. 36 and 37, the front surface of the shield 214 is shown to be flat, though it is understood that this surface may be concave or convex.

The one-piece devices 110 and 220 are intended for bunting practice only, and not for full swing batting practice or game usage.

In all the embodiments, the shields 14, 114 and 214 have a width greater than the bat diameter, so as to protect the batter's upper hand from being hit by a pitched ball. Such protection will help overcome fear of being hit by the pitch which some batters may experience. Also, forward or outer end of the shields 14, 114 and 214 help position the batter's upper hand in the proper position on the bat for bunting and maximum but control during bunting. With repeated practice, the batter will achieve muscle memory for the correct bunting hand position on the bat. The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. In combination, a ball bat having a barrel and grip portion, and a bunting attachment, the attachment comprising:

an elongated shield;

at least one fastener for mounting the shield onto the bat so that the shield extends along a front portion of the bat so as to cover the grip portion and a portion of the barrel;

the shield shields a batter's top hand positioned on the barrel during bunt training and shields a batter's lower hand on the grip portion during bunt training.

2. The combination of claim 1 wherein the shield has a concave surface for contacting the bat.

3. The combination of claim 1 wherein the shield has at least one leg for engaging the bat.

4. The combination of claim 3 wherein the shield has a front plate spaced apart from the bat by the leg.

5. The combination of claim 3 wherein the leg has a concave surface for engaging the bat.

6. The combination of claim 3 wherein the shield has a forward end positioned near a barrel of the bat so as to properly position the batter's upper hand on the bat for bunting.

* * * * *